US006654970B1

(12) United States Patent
Van

(10) Patent No.: US 6,654,970 B1
(45) Date of Patent: Dec. 2, 2003

(54) PASSIVE QUANTITATIVE LIQUID DISPENSER

(76) Inventor: Jack F. J. Van, 3F, No. 14, Lane 98, An-Chu St., Taipei (TW)

( * ) Notice: Subject to any disclaimer, the term of this patent is extended or adjusted under 35 U.S.C. 154(b) by 0 days.

(21) Appl. No.: 10/140,250

(22) Filed: May 8, 2002

(51) Int. Cl.[7] ..... E03D 9/03
(52) U.S. Cl. ..... 4/227.6; 4/227.1
(58) Field of Search ..... 4/227.1, 227.4–227.7

(56) References Cited

U.S. PATENT DOCUMENTS

| | | | | | |
|---|---|---|---|---|---|
| 3,061,842 | A | * | 11/1962 | Woodruff | 4/225.1 |
| 4,396,522 | A | * | 8/1983 | Callicott et al. | 510/193 |
| 4,507,811 | A | * | 4/1985 | Buelow et al. | 4/225.1 |
| 4,745,638 | A | * | 5/1988 | Richards | 4/227.6 |

* cited by examiner

*Primary Examiner*—Charles E. Phillips

(74) *Attorney, Agent, or Firm*—Birch, Stewart, Kolasch & Birch, LLP

(57) ABSTRACT

A liquid dispenser employs passive driving force resulting from water level variations in the water tank of a toilet to dispense a quantitative amount of liquid into toilet bowl of each Flush is disclosed. A sanitary concentrate detergent of a selected formula is filled and sealed in a bottle and mounted to a float quantitative dispensing device in a dilute buffer chamber. Through up and down movement of a float quantitative barrel, a constant amount of concentrate liquid is squeezed and isolated into the dilute buffer chamber for dilution. The whole dispenser apparatus is hung inside. the toilet tank at a desired elevation by means of suction force of a sucking disc. A dispensing probe is provided which has an inlet/outlet submerged in the low portion of the toilet tank. When toilet is flushed, most diluted detergent in the dispenser is flushed into the toilet bowl for cleaning use, and only a small amount of the diluted detergent is retained in the toilet tank. The liquid dispenser uses the principle of liquid partial pressure difference and gravity force feeding. The precision of sampling volume is not changed along with the residual liquid in the liquid bottle.

5 Claims, 8 Drawing Sheets

PASSIVE QUANTITATIVE LIQUID DISPENSER

FIELD OF THE INVENTION

The present invention relates to quantitative liquid dispensers, which employ a suction disc for mounting in a water vessel, such as a toilet tank whose level of water is changing from an upper level to a lower lever and vice versa. The dispenser of this invention is capable to dispense a fix volume of concentrate cleansing liquid and dilute the liquid in a buffer chamber for a sanitary system.

BACKGROUND OF THE INVENTION

Conventional automatic sanitary methods for toilet bowl can be categorized in two types:

One type is to mount a toilet rim dispenser that contains cleansing block, cleansing jelly or cleansing concentrate liquid. Flush water flows over the dispenser and carries the detergents into the toilet for cleaning. Because the dispenser is hung inside the toilet, it occupies space, is not slightly, and gives people unsanitary impression. Moreover, the hanging band or hook makes the toilet seat tilted unevenly, and some toilet designs and constructions are not suitable for hanging dispensers.

Another type of cleaning method is directly placing cleansing block into the toilet tank. It has disadvantages of poorer cleaning effect; color pigments are added to the detergents to function as indicators, and there is no strong fragrance. Moreover, the cleansing blocks are blended with a full tank of water, and result in fast decomposition. They are dissolved and consumed rapidly even when the toilet is not being used. There is a self-lasting life when placed in toilet tank. It causes a lot of waste.

SUMMARY OF THE INVENTION

In view of aforesaid disadvantages, the primary object of the invention is to provide an automatic sanitary dispenser that is held in the water tank of a toilet. The sanitary dispenser of the invention is hung through a sucking disc without hooks. Thus there are not concerns of installation height and location for the dispensers that incur to tank rim hanging type dispensers. It may be adaptable to any types of toilet tanks. Volumetric concentrate liquid of specific fragrance and cleansing property is dispensed in a dilute buffer chamber and is diluted quantitatively with water. A flat and elongate hollow dispensing probe is provided to control water intake and discharge and to completely isolate the diluted solution. The dispensing probe has an inlet/outlet mean submerging in the bottom section of the toilet tank. The dilute buffer chamber is located on the upper portion of the dispensing probe and has two openings to communicate with the dispensing probe. During toilet flushing, this predetermined quantitatively diluting liquid is discharged into the toilet. Only a small amount of diluted detergents are retained in the water tank and blended with water. The dispenser of the invention consumes only a small amount of concentrate detergents for every. flush, and most of the dilute detergents are flushed into the toilet.

When the dispenser of the invention is used in the water tank of a toilet, based on fragrance and foaming condition, users may be aware when to replenish the concentrate detergents. When the toilet is in automatic flush operation, the preferable method is to flush clean water first, then flush with detergents such that the detergents may be retained in the toilet to achieve optimum cleaning and sanitary effect.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
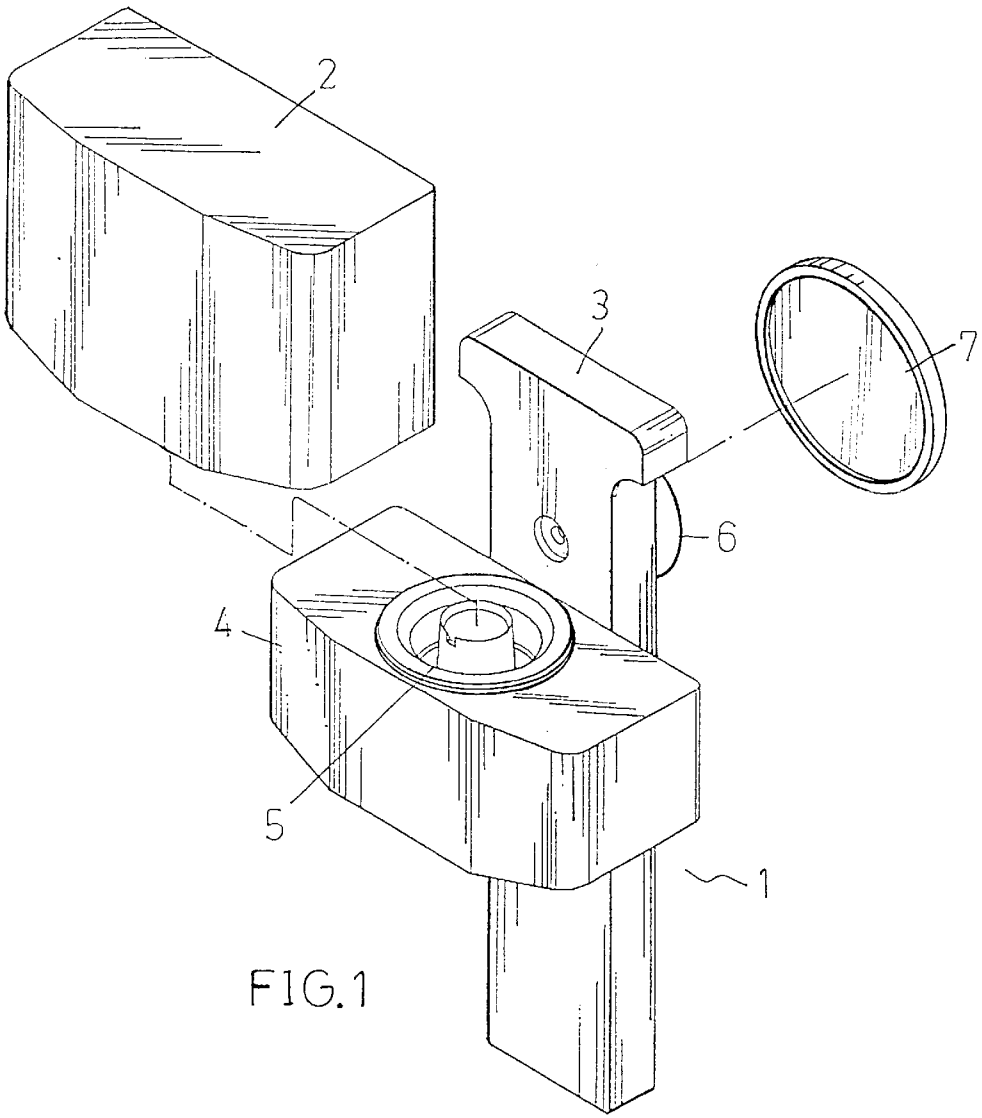
FIG. 1 is a perspective view of a liquid dispenser of the invention, showing a liquid bottle and a sucking disc.

Refer to FIG. 1 for a liquid dispenser 1 of the invention. It mainly consists of a liquid bottle 2, a dispensing probe 3, a dilute buffer chamber 4, a float quantitative device 5, a sucking disc 6 and an anchor disc 7.

Figure 2:
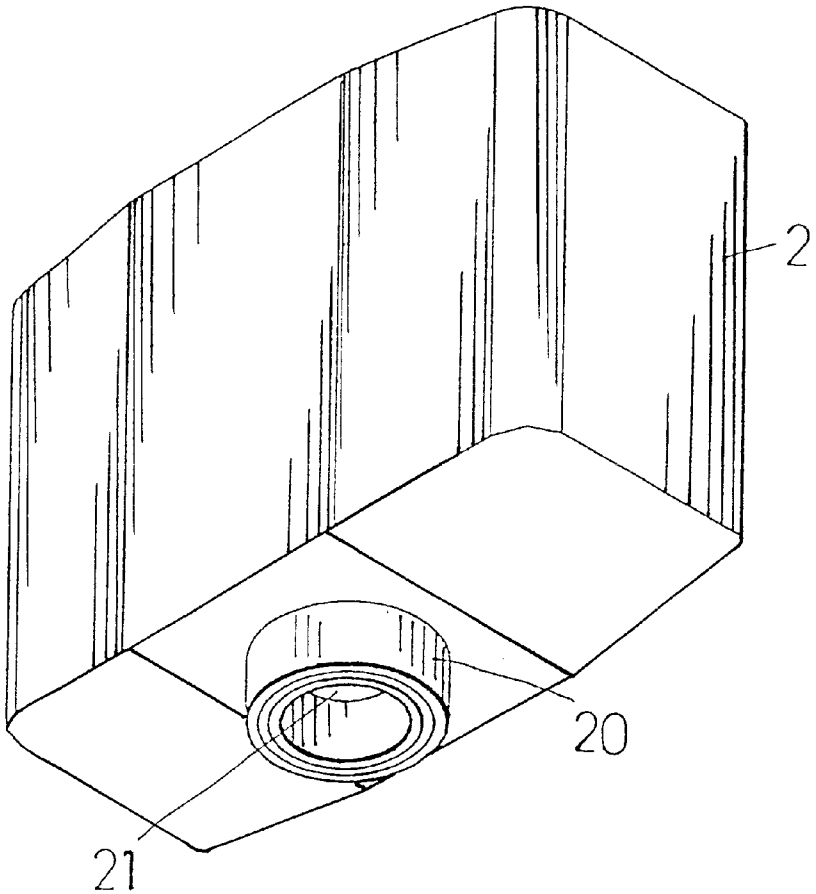
FIG. 2 is a perspective view of a liquid bottle of the invention.

The liquid bottle 2 (also referring to FIG. 2) is a hollow box type container and has a seal cap 20 located on a bottom end thereof. The bottom section of the seal cap has a crack opening 21 which may be cracked and opened by under compression.

The dispensing probe 3 is an elongate, flat and hollow box type member formed substantially in a T shape. At the upper section, there are a lower opening 35 and an upper opening 36 (referring to FIGS. 3 and 4). At the bottom end of the dispensing probe 3, there is an inlet/outlet 30. The bottom end has a pair of partitions 31 to form a U-shaped pressure trap passage 32 consisting of two symmetrical U-shaped channels. Water or dilute solution may pass. into or outside the dispenser through the inlet/outlet 30. The top end of the dispensing probe 3 has two air vents 33 and forms substantially a cap in an inverse U shape with two gaps 34 formed on two sides thereof such that the air vents 33 have the openings directing downwards at two sides thereof.

Figure 3:
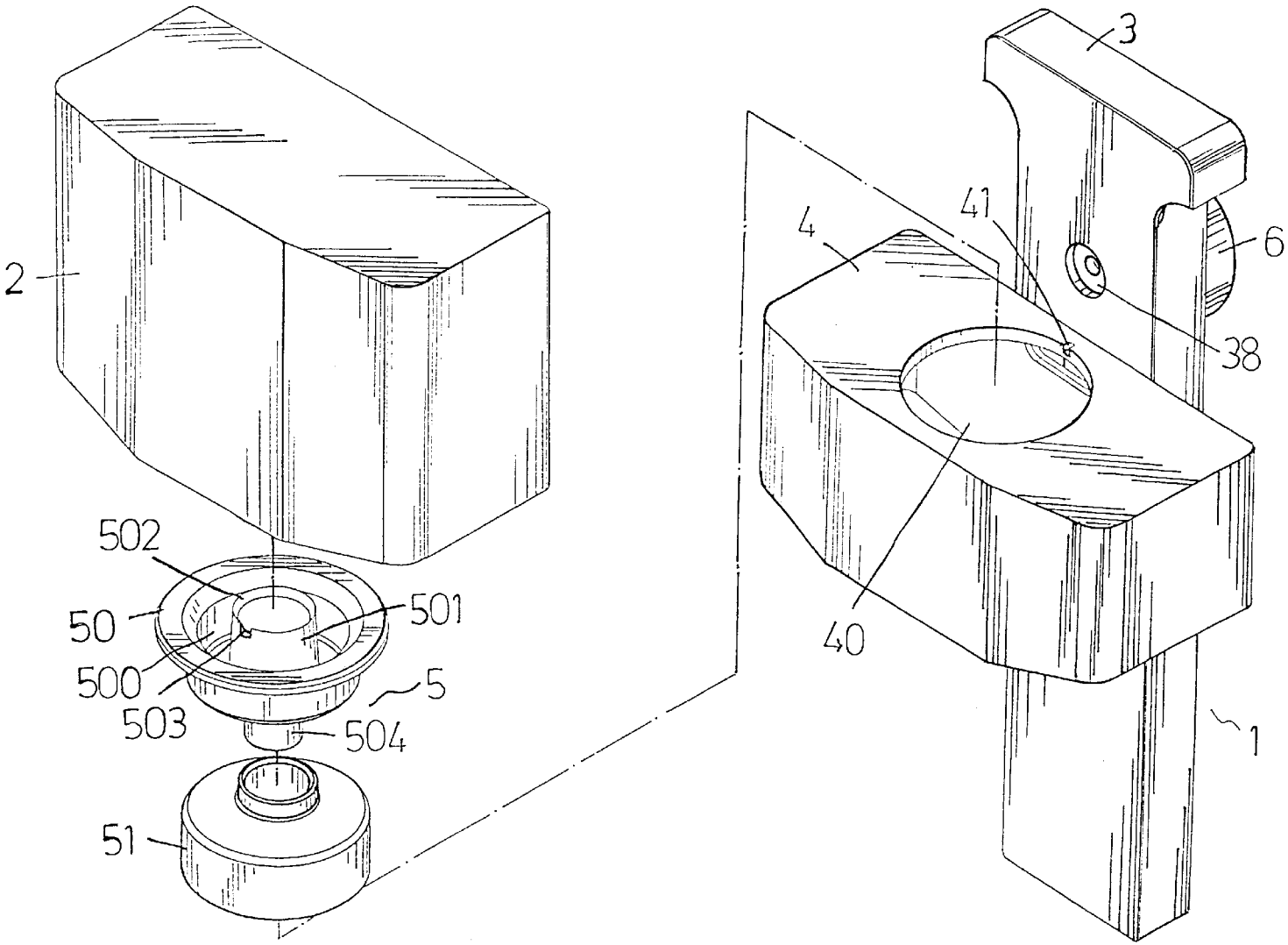
FIG. 3 is an exploded view of the invention.
Figure 4:
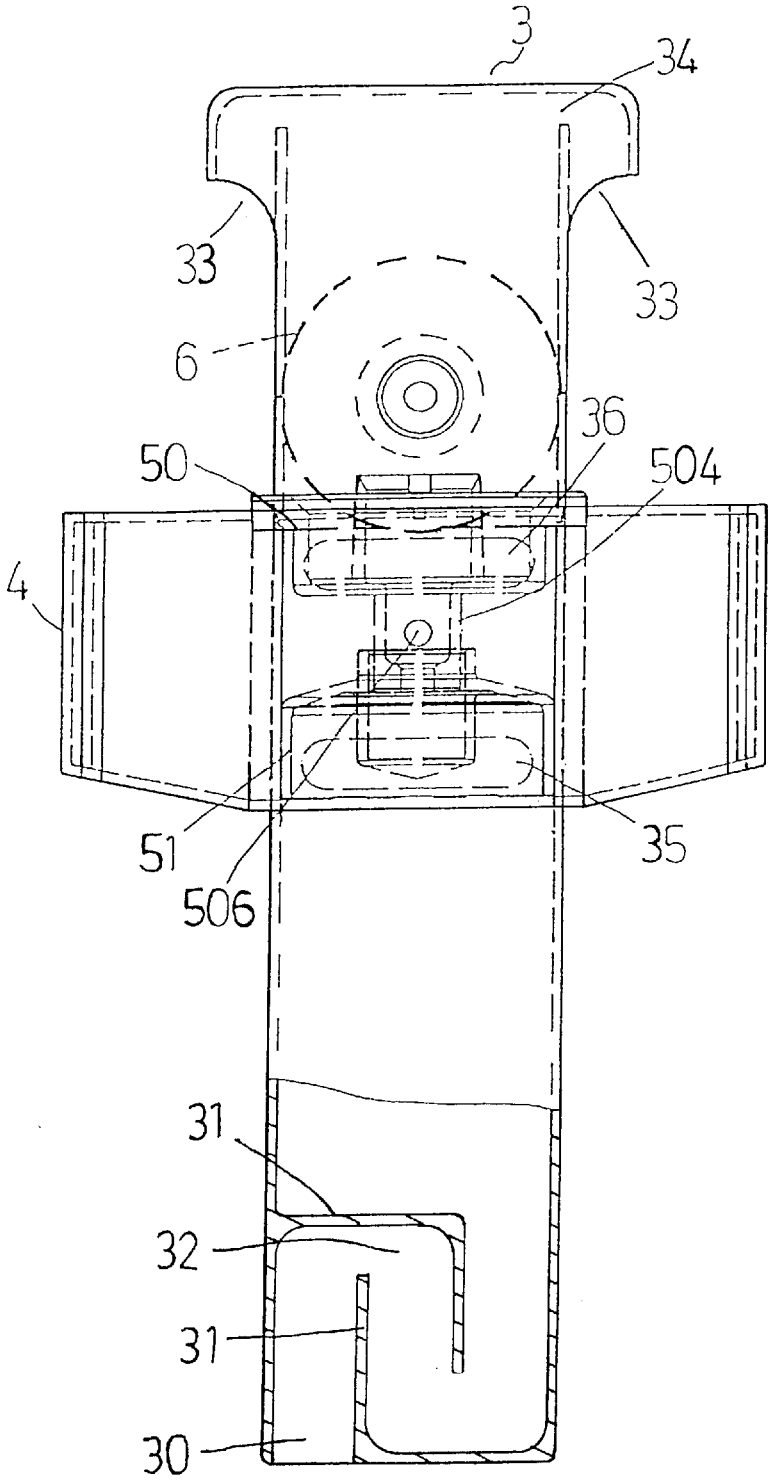
FIG. 4 is a front view of a liquid dispenser of the invention.

Referring to FIGS. 3 and 4, the dilute buffer chamber 4 is a box type container for diluting concentrate liquid. On a lateral side of the dilute buffer chamber, there are two openings located respectively at an upper elevation and a lower elevation to bond tightly and communicate with the upper opening 36 and the lower opening 35 of the dispensing probe 3. The dilute buffer chamber 4 has a top end with an capsule opening 40 formed thereon and an anchor notch 41. The float quantitative device 5 includes a base dock 50 and a quantitative float barrel 51 (also referring to FIGS. 3, 4, 5 and 6). The quantitative float barrel 51 is housed in the dilute buffer chamber 4 through the capsule opening 40. The base dock 50 is engaged tightly with the capsule opening 40. The base dock 50 has an indented trough 500 formed on the upper section. There is a liquid channel tube 501 extending upwards from the center of the indented trough 500. The top end of the channel tube 501 forms a sharp opening 502 and a notch 503 to prevent blocking of the liquid inlet. The bottom section of the channel tube 501 connects to a cylindrical drip tube 504 which has a bottom end with an outlet 505 formed thereon to allow concentrate liquid to flow out. The drip tube 504 has an aperture 506 formed on the side wall thereof. The lower end of the drip tube 504 couples with the quantitative float barrel 51 which may be moved only up or down. The quantitative float barrel 51 has a cylindrical trough 510 and opening 511 to match and couple with the drip tube 504. The bottom end of the quantitative float barrel 51 forms a full opening 512.

Figure 7:
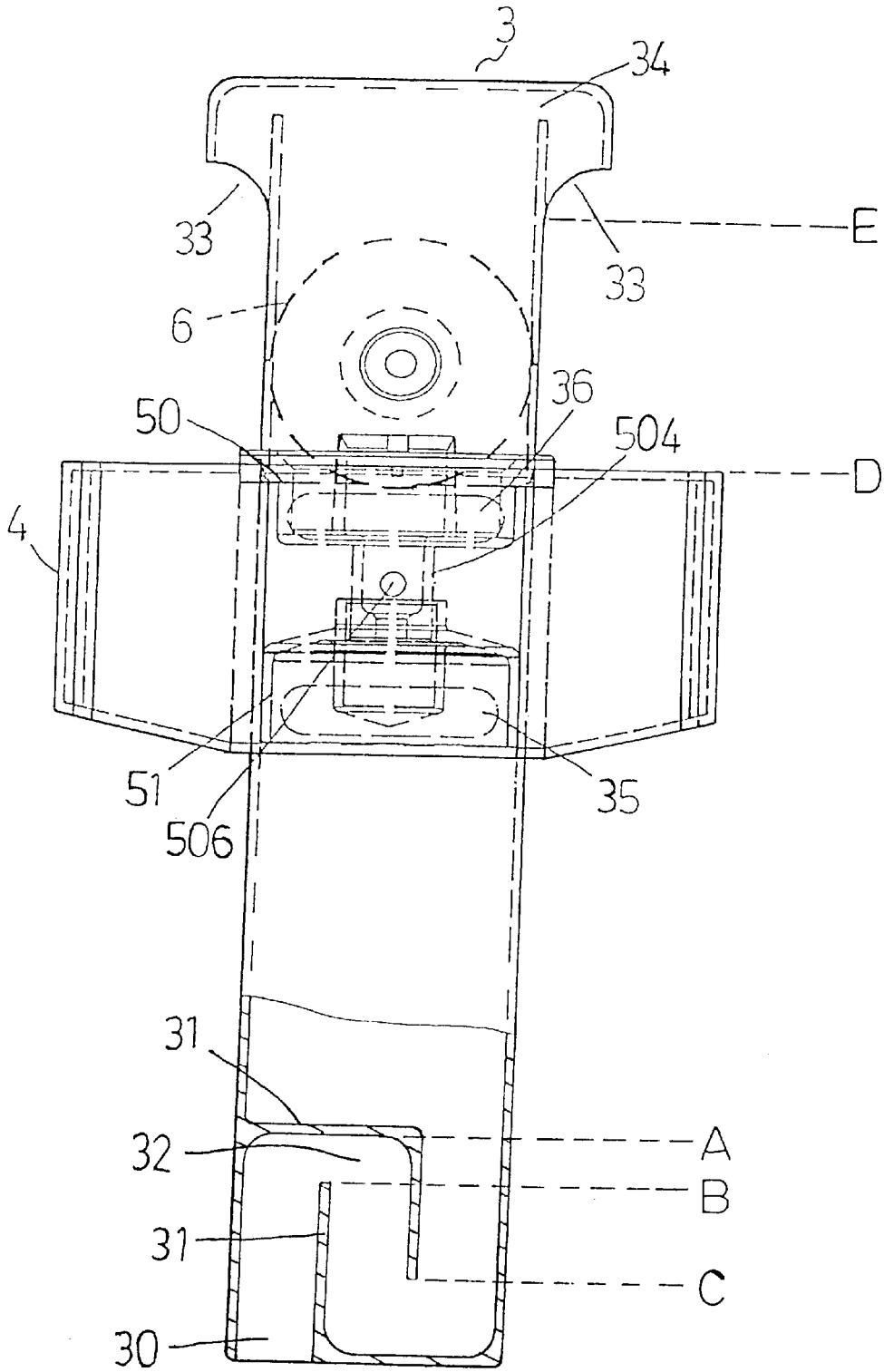
FIG. 7 is a front view, partly cutaway, of an inlet/outlet mean of the dispensing probe of the invention.

Referring to FIG. 7, when water flows in, A, B, and C represent water levels. (A–B) represents differential liquid pressure between A and B, and (B–C) represents differential liquid pressure between B and C. When water level outside the dispensing probe 3 is greater than [B+(B–C)–(A–B)], water starts overflowing the point B and enters into the dispensing probe 3 through the inlet/outlet 30, and water level starts to rise continuously and flows into the dilute buffer chamber 4 through the two openings at the upper and lower elevation that communicate with the dispensing probe 3; water level continues to rise and reaches the upper opening 36 of the dispensing probe 3 to communicate with the dispensing probe 3. D represents the lowest working water level of the water tank for the liquid dispenser 1. E represents the normal working water level. When in use, if water level exceeds point E and submerges the air vents 33, the liquid dispenser 1 still can function properly. When water intake is completed and water level becomes still, a selected amount of water flows into the liquid dispenser 1 to blend with detergents to form diluted detergent liquid. After water intake, dissolved diluted liquid may be held still for a long period of time (more than two weeks) without flowing out through the inlet/outlet 30 at the bottom end of the dispensing probe 3. Whether water level covers the dispensing probe 3 or not. The dissolved diluted liquid also does not flow out through the air vents 33 at the top end. As the top end is covered by the inverse U-shaped cap which can trap air, the gaps 34 have air to isolate the diluted liquid. The inlet/outlet 30 at the bottom end is an opening employs pressure difference in the U-shaped pressure trap passage 32. Because (B–C)>(A–B), experiments show that the dilute liquid which has a greater specific gravity than water does not flow over point B or flows out. In the event of (B–C)< (A–B), the dilute liquid flows over B point and flows out slowly from the dispensing probe 3.

Figure 6:
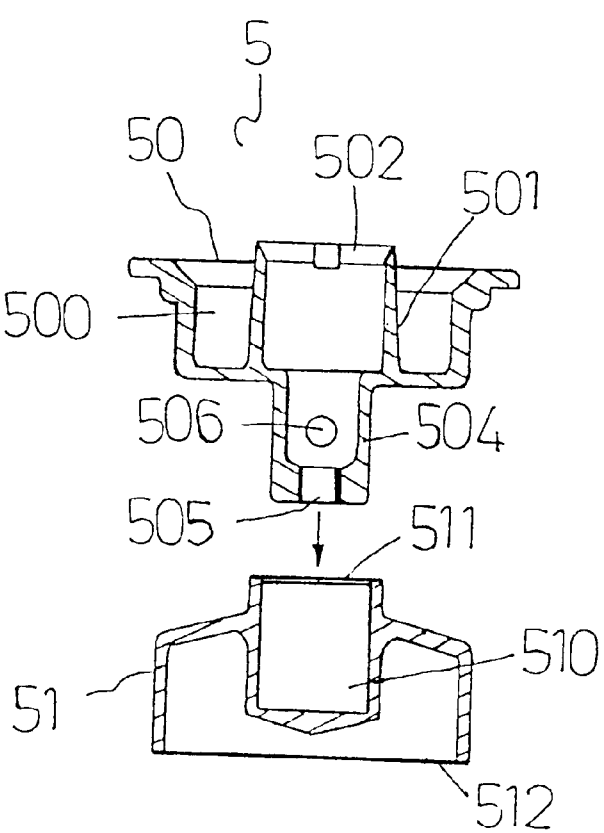
FIG. 6 is an exploded sectional view of a float quantitative device of the invention.
Figure 5:
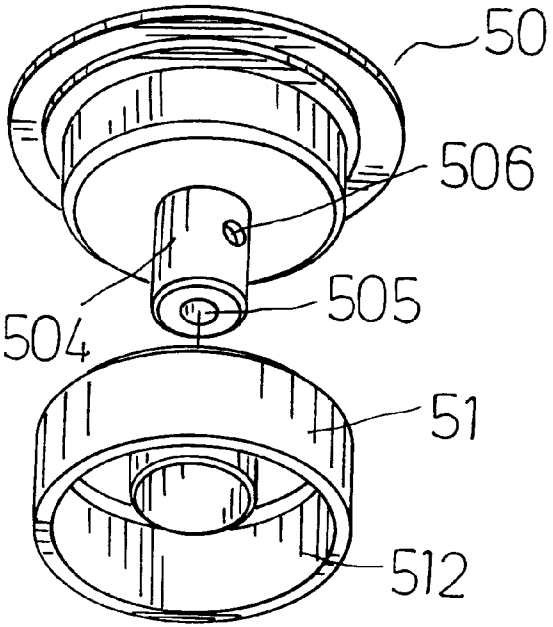
FIG. 5 is a perspective view of a float quantitative device of the invention.

Referring to FIG. 4 and FIG. 6, because the differential gravity of the liquid level between aperture 506 and outlet 505 is higher than threshold Force, the inventor of the present invention designates the threshold Force as Force of breakthrough (Fb) temporarily. The threshold Force (Fb) of the present invention is a lowest gravity force feeding which drives air to flow in a drip tube 504 from aperture to form an air bulb raising upward in the liquid bottle 2 to replace the space, so that the liquid flows from the outlet 505 into the through 510. When concentrate detergent liquid flows through the outlet 505 into the trough 510, the liquid level in the trough rises and the liquid stops flowing out when the liquid level reaching the air aperture 506. In that condition, gravity of the liquid level difference is proximate to or smaller than Fb. Tensile strength of liquid around aperture 506 becomes smaller and air bubbles cannot be generated to allow air to enter into the tube 504. Based on the principle of liquid partial pressure and gravity force feeding, the flow speed is faster when more liquid contained in the liquid bottle 2. However, Fb value has no relationship with the amount of liquid contained in the liquid bottle 2, i.e. the control position for stopping liquid flowing out does not change because of different amount of liquid contained in the liquid bottle 2. When water enters, the rising water level moves the quantitative float barrel 51 upwards to compress liquid held in the trough 510 such that liquid in the trough flows out of the trough air aperture 506 and opening 511. The quantitative float barrel 51 continuously rises and reaches the base dock 50 and completely surrounds and seals the entire cylindrical drip tube 504. The up and down displacement of the quantitative float barrel 51 and the outer diameter of the cylindrical drip tube 504 enable the quantitative float barrel 51 to squeeze and release a constant amount of concentrate liquid in every up and down movement into the dilute buffer chamber 4 for dilution. The dispenser thus constructed therefore forms a completely separated and quantitative dilution system.

During flushing, water level drops, and when water level pressure difference outside the dispensing probe 3 is greater than the pressure difference (B–C)–(A–B) in the U-shaped pressure. trap passage 32, dilute liquid starts flowing out through the inlet/outlet 30 of the dispensing probe 3. As most of the dilute liquid is stored in the upper section of the dispensing probe 3, and the inlet/outlet 30 is located in the lower half section of the water tank, after water is flushed about 5–10 seconds, most of the dilute liquid is flushed into the toilet, and only a small amount of the dilute liquid remains in the water tank.

Another characteristics of the invention is to use suction force of a sucking disc 6 to mount the dispenser 1 on the inner wall of the water tank in a suspension manner. Referring to FIGS. 1 and 4, the sucking disc 6 is fixedly located on an opening 37 on the right side of the dispensing probe 3. There is an air vent 38 on the other side for installation use. The anchor disc 7 has a protrusive perimeter with a smooth surface 70. The anchor disc 7 has another side applying with silicone adhesive or other adhesives for adhering the anchor disc 7 to the inner wall of the water tank at a desired elevation. Then the sucking disc 6 may be mounted to the smooth surface 70 by means of suction force by compressing the sucking disc 6 against the anchor disc 7. The entire dispenser 1 thus may be hung thereon. Testing with additional weights in various temperatures (4–25 degrees Celsius) shows that, the non-slipping suction force of the sucking disc 6 is about 1200 grams, and the maximum loading weight of the suction force without breaking off is about 1800 grams. Both are far greater than the maximum weight of 200 grams that has been commonly adopted for a regular dispenser 1. Test for suction time duration capability is done by simulations of adding an extra weight to shorten testing time period. A test was done by hanging a weight of 700 grams to the sucking disc 6 in a static condition. There was no slipping or breaking off occurred after two months have been elapsed. The outcome indicates that the invention can meet requirements of practical applications. General plastic water tanks made by thermosetting usually have smooth inner surfaces, hence the sucking disc 6 can be directly adhered thereon without using the anchor disc 7. However ceramic water tanks generally have porous inner surfaces, the anchor disc 7 is required to mount the sucking disk 6 to the inner wall of the ceramic water tanks. Installation of the whole dispenser system of the invention by means of the sucking disc 6 and anchor disc 7 is very simple and easy, and may be adopted for any types of toilets. Moreover, the dispenser 1 of the invention may be mounted to any elevation in the water tank and still function properly, even in the condition of being submerged in the water. Nevertheless, in practice, it is still preferably to mount the dispenser 1 to a desired water level to allow water flushing first, then flush the dilute detergent liquid so that some dilute detergent liquid will be retained in the toilet bowl to achieve most effective sanitary results.

Figure 8:
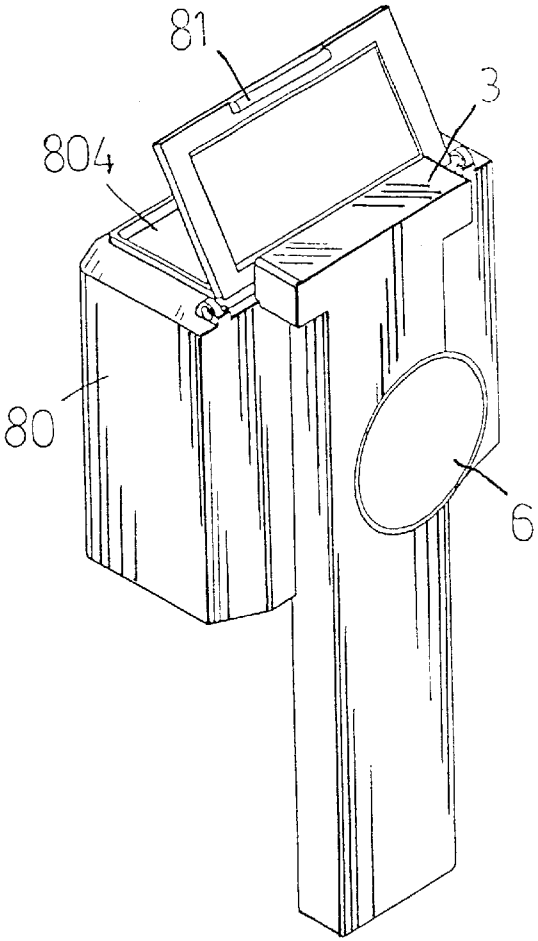
FIG. 8 is a perspective view of yet another embodiment of the dispenser of the invention.
Figure 10:
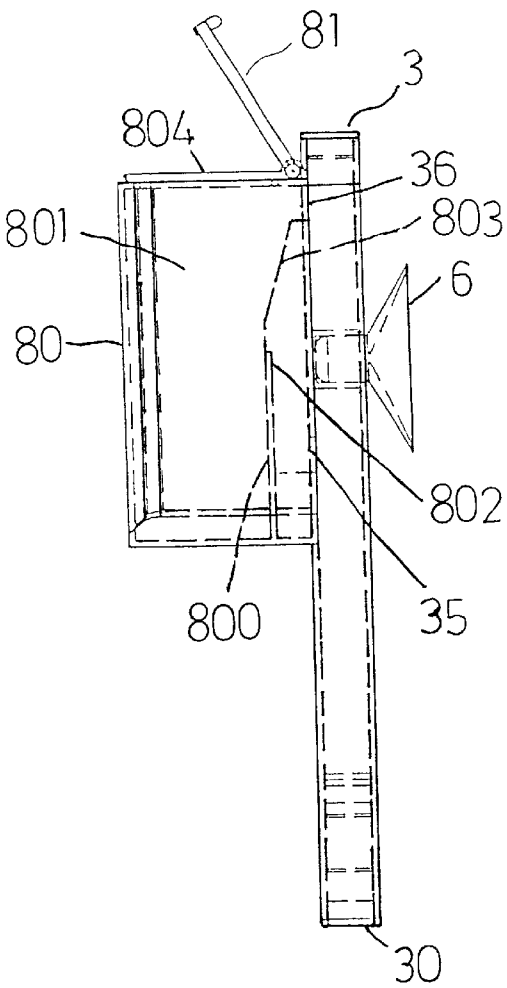
FIG. 10 is a side view of yet another embodiment of the. dispenser of the invention.
Figure 9:
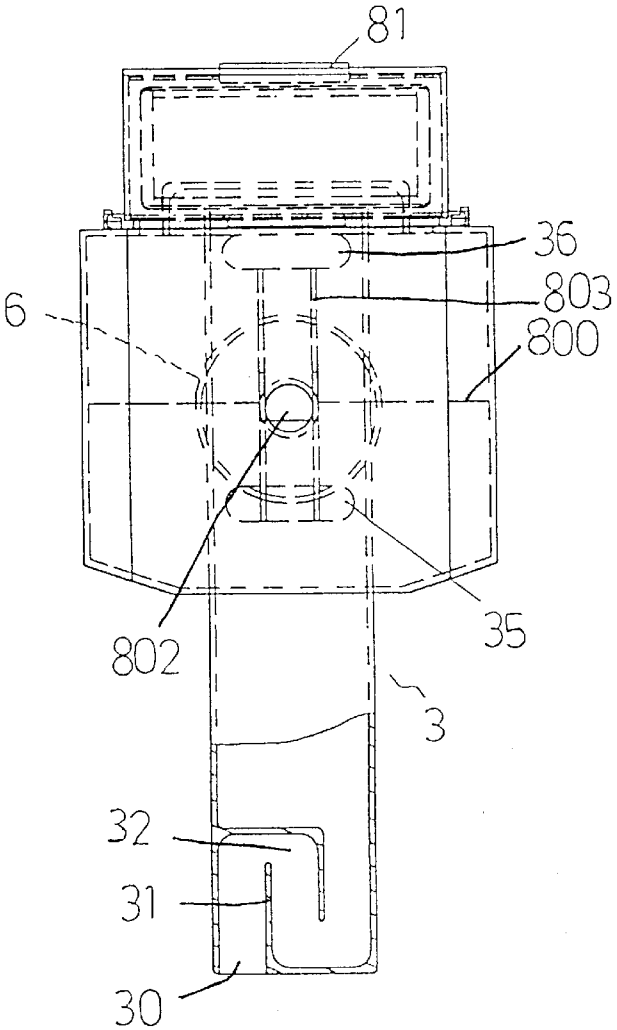
FIG. 9 is a front view of yet another embodiment of the dispenser of the invention.

In another embodiment of the invention for a dispenser 8 (referring to FIG. 8), operation principles of the sucking disc 6, anchor disc 7, and dispensing probe 3 are same as those of the liquid dispenser 1. However there is no liquid quantitative device 5. And the interior construction of the dilute buffer chamber 80 is altered. Referring to FIGS. 9 and 10, the dilute buffer chamber 80 has openings to communicate with and fasten to the dispensing probe 3 through the openings 35 and 36. In the dilute buffer chamber 80, there is a partition 800 to separate and form a storage compartment 801 for holding Lavatory cleansing block or jelly. The partition 800 has an opening 802 formed on an upper section. There is a top opening 804 formed on the top end of the dilute buffer chamber 80 and is coupled by a movable lid 81. Cleansing block or jelly may be dropped into the storage compartment 801 of the dilute buffer chamber 80 through the top opening 804. There is another partition 803 to channel the cleansing block moving correctly into the storage compartment. Cleansing jelly may be added to a height without exceeding the lower section of the opening 802. Once cleaners are added through the top opening 804, the movable lid 81 may be closed to seal the top opening 804. Feeding water enters through the inlet/outlet 30 of the dispensing probe 3 and rises to the lower opening 35 and enters into the dilute buffer chamber 80, then flows over the partition 800 to blend with the cleansing material contained in the storage compartment 801; and slowly dilute and disperse into the dispenser 8. By means of up and down of water level, irregular amount of cleansing materials may be flushed into the toilet bowl.

Industrial Applicability

The quantitative liquid dispenser of the invention may be used to dispense liquids from a reservoir or bottle, and in particular may be used in the toilet tank to dispense quantitative cleansing liquids into a toilet bowl.

What is claimed is:

1. A lavatory cleaning dispenser, comprising:

at least one sucking disc having suction force to hang the entire dispenser on a selected location and at a desired water level on an inner wall of a toilet tank when compressed, or being sucked and adhered to a smooth surface of an anchor disc fixedly mounted to the inner wall of the toilet tank;

a dispensing probe formed in a flat and elongate hollow duct having a U-shaped pressure trap passage to control intake of water and discharge of dilute liquid in the dispensing probe and isolate the dilute liquid from leaking, and an inverse U-shaped lid formed on a top end thereof with air vents directing downwards, and separating a liquid from flowing from a top thereof by using a formed air chamber, and an inlet/outlet formed on a bottom end thereof connecting to the U-shaped pressure trap passage, the dispensing probe further having an upper section which has one side fixedly attaching to the sucking disc and another side having an upper opening and a lower opening formed thereon; and a dilute buffer chamber formed in a box type container for storing and diluting use having one side with two openings formed thereon to communicate with and connect an upper section of the dispensing probe, and a top opening engaging with a movable lid for opening or closing the top opening, the top opening allowing a cleansing materials to drop into a storage compartment formed in the dilute buffer chamber for storing and dissolving, the storage compartment having a partition located therein, the partition having an opening;

wherein water and the dilute liquid being controlled to enter in or discharged from the dispenser through the inlet/outlet of the dispensing probe through the pressure trap U-shaped passage such that the dilute liquid is isolated without leaking in static conditions, water is allowed to flow over the partition to blend with oversaturated solution to dispense the cleansing materials in a diluting and dissolving fashion.

2. A quantitative liquid dispenser, comprising:

at least one sucking disc having suction force to hang the entire dispenser on a selected location and at a desired water level on an inner wall of a toilet tank when compressed, or being sucked and adhered to a smooth surface of an anchor disc fixedly mounted to the inner wall of the toilet tank;

a dispensing probe formed in a flat and elongate hollow duct having an U-shaped pressure trap passage to control intake of water and discharge of dilute liquid in the dispensing probe and isolate the dilute liquid from leaking, and an inverse U-shaped lid formed on a top end thereof with air vents directing downwards and separating a liquid from flowing from a top thereof by using a formed air chamber, and in inlet/outlet formed on a bottom end thereof connecting to the U-shaped pressure trap passage, the dispensing probe further having an upper section which has one side fixedly attaching to the sucking disc and another side having an upper opening, and a lower opening formed thereon;

a dilute buffer chamber formed in a box type container for diluting concentrate liquid having one side with two openings formed thereon to communicate with and connect an upper opening and a lower opening of the dispensing probe to allow water to flow in or out of the dilute buffer chamber, and storing most of the dilute liquid; the dilute buffer chamber having an interior forming a sealed space with a float quantitative device hung therein; the float quantitative device having a lower end coupling a floating quantitative float barrel which dispenses and isolates a selected amount of the concentrate liquid into the dilute buffer chamber for dilution by principles of liquid partial pressure difference and gravity force feeding for every up and down movement; and a float quantitative dispensing device and a liquid bottle, the liquid bottle having a seal cap which has a bottom section forming a crack opening openable under compression, the float quantitative device include a base dock housed in and fastened to the dilute buffer chamber, the base dock having a channel tube located in the center thereof, the channel tube having a top end with an opening formed thereon for engaging with the liquid bottle to receive liquid from the liquid bottle, the base dock having a cylindrical drip tube located below the channel tube, the cylindrical drip tube having a bottom end with an outlet formed thereof and one side with at least one air aperture formed thereon, the position level difference between the outlet and the air aperture incurring a differential gravity to force liquid flowing out through the outlet and to allow air flowing into the drip tube through the air aperture, the quantitative float barrel being movably engaged with a lower section of the cylindrical drip tube and being movable up and down therewith, the quantitative float barrel having a cylindrical trough formed in the center thereof to match and couple with the cylindrical drip tube;

wherein the dispenser is hung on the inner wall of the toilet tank by means of the suction force of the depressed sucking disc, water and the dilute liquid being controlled to enter in or discharged from the dispenser through the inlet/outlet of the dispensing probe through the pressure trap U-shaped passage such that the dilute liquid is isolated without leaking in static conditions, the dilute buffer chamber being located on an upper half section of the dispenser with the float quantitative device and the sealed liquid bottle located therein such that the quantitative float barrel is moved up to press against the base dock for surrounding and sealing the entire drip tube when water is fed and the quantitative float barrel is moved up and down to release and isolate a constant amount of the concentrate liquid for diluting and dispensing into a toilet for sanitary cleaning use.

3. The quantitative liquid dispenser of claim 2, wherein the liquid bottle is located on an upper half section of the dispenser and has a changeable size of containing volume and is mountable on the same dispenser.

4. The quantitative liquid dispenser of claim 2, wherein the float quantitative dispensing device functions according to the principles of liquid partial pressure difference and gravity force feeding with a differential gravity of the liquid level between an aperture and outlet of the drip tube being higher than a threshold force, the threshold force being a lower gravity force feeding which drives air to flow in a drip tube from an aperture to form an air bulb raising upward in the liquid bottle to replace the space, so that the liquid flows from the outlet into the through, when the liquid in the through rises upwards it stops when being close to the threshold force when the differential gravity between the liquid and the aperture stops; the liquid being distributed in a fixed quantity through an outer diameter of the round drip tube and under the upward and downward motion of a quantitative float barrel; the threshold force being unchanged along with the residual liquid in the liquid bottle, so that a fixed quantity of the liquid is distributed regardless of how much liquid is left in the bottle.

5. The quantitative liquid dispenser of claim 2, wherein the cleaning material comprises:

a. at least one cleansing compartment for generating foaming bubbles to notify users when to replenish the detergent material;

b. at least one aromatic additive for generating fragrant air when the toilet is flushed;

c. at least one surfactant agent; and d. selected bleaching agents or gemicides.

* * * * *